US006395345B1

(12) United States Patent
Sørensen

(10) Patent No.: US 6,395,345 B1
(45) Date of Patent: May 28, 2002

(54) COATING MATERIAL AND APPLICATION METHODS THEREFOR

(76) Inventor: Frede Sørensen, Bymarksvej 8, Langå(DK), DK-8870

( * ) Notice: Subject to any disclaimer, the term of this patent is extended or adjusted under 35 U.S.C. 154(b) by 0 days.

(21) Appl. No.: 09/529,420

(22) PCT Filed: Oct. 30, 1998

(86) PCT No.: PCT/DK98/00475

§ 371 (c)(1),
(2), (4) Date: May 1, 2000

(87) PCT Pub. No.: WO99/22879

PCT Pub. Date: May 14, 1999

(30) Foreign Application Priority Data

Nov. 13, 1997 (DK) ..... 1997 01293

(51) Int. Cl.[7] ..... B05D 1/04

(52) U.S. Cl. ..... 427/475; 427/486; 427/195; 427/314

(58) Field of Search ..... 427/214–217, 427/2.21, 2.29, 447, 185, 195, 314, 459, 461, 475, 486

(56) References Cited

U.S. PATENT DOCUMENTS

| | | | | |
|---|---|---|---|---|
| 2,844,489 | A | * | 7/1958 | Gemmer |
| 3,872,040 | A | | 3/1975 | Mollohan et al. |
| 3,911,161 | A | * | 10/1975 | Nord et al. |
| 3,989,859 | A | * | 11/1976 | Koerper |
| 4,263,538 | A | * | 4/1981 | Rentmeester et al. |
| 4,631,302 | A | * | 12/1986 | Supcoe et al. |
| 5,285,967 | A | | 2/1994 | Weidman |
| 5,470,603 | A | | 11/1995 | Staniforth et al. |
| 5,834,673 | A | * | 11/1998 | Gustavsson et al. |

FOREIGN PATENT DOCUMENTS

| | | | |
|---|---|---|---|
| DE | 40 35 406 | * | 5/1992 |
| FR | 2 762 635 | | 10/1998 |
| GB | 2 014 065 | | 8/1979 |
| GB | 1 586 758 | | 3/1981 |
| HU | 55 076 | * | 4/1991 |
| JP | 5-125823 | * | 5/1993 |
| WO | WO 97/41175 | | 11/1997 |

OTHER PUBLICATIONS

WPI Derwent Abstract, Accession No. 97–207393, Abstract of Japan 9057188 (Kobe Steel Ltd.), Mar. 4, 1997, & Patents Abstracts of Japan, JP 9057188, vol. 97, No. 007, Jul. 31, 1997, English Abstract.

WPI/Derwent Abstract, Accession No. 91–167091, Abstract of Japan, 3098679 (Kobe Steel Ltd.), Apr. 24, 1991, & Patent Abstracts of Japan, JP 3098679, vol. 15, No. 285, Jul. 19, 1991, English Abstract.

WPI/Derwent Abstract, Accession No. 98–590088, Abstract of Japan, 10265939 (Microntech KK), Oct. 6, 1998, English Abstract.

WPI/Derwent Abstract, Accession No. 97–328447, Abstract of Japan, 9132523, (Shinetsu Chem Ind Co Ltd), May 20, 1997, & Patent Abstracts of Japan, JP 9132523, vol. 97, No. 930, Sep. 30, 1997, English Abstract.

May 20, 1997, & Patent Abstracts of Japan, JP 913252, (Shinetsu Chem Ind Co Ltd), Abstract.

WPI/Derwent Abstract, Accesson No. 95–064968, Abstract of NZ, 237879, (Coles T J), Dec. 22, 1994, English Abstract.

WPI/Derwent Abstract, Accession No. 93–201002, Abstract of JP, 5125823, (Mitsui Toatsu Chem Inc), May 21, 1993; & Patent Abstracts of Japan, JP, A, 5125823, vol. 017, No. 500, Sep. 9, 1993, English Abstract.

* cited by examiner

*Primary Examiner*—Fred J. Parker
(74) *Attorney, Agent, or Firm*—Nixon Peabody LLP; David S. Safran

(57) ABSTRACT

A coating material of a modified, climate resistant wax substance, which is applicable in melted condition, has been found to be perfectly applicable not only from an already melted wax bath, but still better if it is used in the form of a powder that can be injected into a blowlamp flame or a flow of hot air. A possible technique for making the powder is disclosed. Smaller articles may be "wax painted" by receiving, in heated condition, a surface layer of the powder.

12 Claims, No Drawings

COATING MATERIAL AND APPLICATION METHODS THEREFOR

BACKGROUND OF THE INVENTION

The present invention relates to novel applications of a special wax material, viz, the material disclosed in WO 97/41175. Compared to ordinary paraffin wax this wax is characteristic in being much harder and in having a noticeably higher softening and melting point, and also in being wear resistant and totally environment friendly. Moreover, the wax is resistant to chemicals and, in suitably heated condition, very well suited for application as a protective coating on a wide variety of surfaces such as metal or wood, with good adhesion and impregnation properties. The wax can be coloured and will thus be highly suited for use as "paint".

A highly efficient painting of articles can be obtained simply by dipping the articles in a bath of the melted wax, or the melted wax can be applied to fixed surfaces by some spraying or brushing technique.

DETAILED DESCRIPTION OF THE INVENTION

According to the present invention, however, it has been found that there is no need for developing special application techniques for the hot wax, inasfar as it has been realized that instead of departing from a "wax bath" made, e.g., of melted pieces of wax, it is in fact possible to depart from the solid wax, viz, with the "hard wax" in a granular condition thereof and make use of already well known methods and equipment for converting granules or powder of more conventional thermoplastic materials into "paint" or "a coating". As a first step it was realized that it would be possible to dip an article into a powder or granular mass of the hard wax in order to obtain a sticky adhesion of the material to the article surface and then subject the thus coated article to a heating treatment in order to make the wax particle coating flowing together into a continuous paint layer. Such an adhesion could be provided for by making the wax particles slightly adhering in incorporating in the wax material a certain amount of an oily constituent. A similar result will be achievable by coating the article with some sticky substance prior to its being dipped into the particulate wax material.

A following step was to realize that the particulate wax material could perhaps be applied to the article surface by the "electrostatic method" as used in connection with powder coating, using opposite high voltages on the article and on a flow of wax particles sent against the article, respectively. At this stage, expert consultants could not predict what would happen, but following experiments demonstrated that the method worked perfectly. In this way, the articles could be moved through an application zone in which they, in a more or less heated condition, e.g., to 40° C. or more, were exposed to a blast of the particulate wax material, whereby there was no need to arrange for a mechanical attraction as by means of adhesives. The particle-coated article could still afterwards be subjected to heat in order to make the particulate coating flowing together into a continuous "paint layer".

Later on it was realized that the granular wax material may in fact be applied in basically the same manner as conventionally used in connection with various types of plastic coating based on the use of granular plastics. Thus, for example, it is possible to arrange for spray painting in causing a flow of small wax granules to pass through a heater unit from a storage container for further delivery of the now melted wax to a discharge spray nozzle. A major breakthrough arose when it was found that, as mentioned below, it is possible to effectively convert the granular material into "powder", whereby it was found that even already existing spraying equipment for applying melted plastic as a surface coating could be perfectly usable in the present connection as mobile or portable units. This implies that the powder is currently injected into a blowtorch flame or a flow of hot air directed against the surface to be treated, and it is envisaged that, in particular, in connection with a protective surface treatment of large, stationary outdoor structures, such as building surfaces, roads and runways, bridges, historical monuments and inner details thereof, etc., it will be possible to use the equipment in such a controlled manner that a surface portion being treated is initially subjected merely to the heating action of the flame or the flow of hot air, so as to be preheated for evaporation of moisture prior to a following initiation of the said powder injection. The powder may become a paint when colored as desired, or a visually and environmentally neutral, highly, protective coating or impregnation, addressing all structures and not least all of the climatically endangered, ancient monuments throughout the world. The same interest, of course, is to be paid to any modern "monument", be it a gravestone, a building surface or a sewer pipe among extremely many other possibilities.

A fully corresponding application technique may be used in connection with the treatment of minor articles, e.g., in connection with car painting or undercarriage rust protection.

To the extent it is desirable to fill out cavities in surfaces being treated it will be possible to currently inject also sand or other particulate matter in the flame or hot air flow, whereby such a filler, without further precautions, will act as a self-adhering filler. Glass granules may be incorporated for rendering the resulting surface light reflecting.

Another possibility is to use, for smaller articles, the "whirl sintering" method, according to which a heated article is lowered into an air fluidized whirling mass of plastic powder or granules, such that the hot article surface will "catch" the particles hitting it, resulting in a rapidly obtained full coating of the article.

For the use of the wax as a raw material for the spray application in connection with already known and applicable techniques it is important that the raw material is a "powder". A natural state of the produced material is in the form of larger granules, which do not amount to a "powder", preferably with a grain size of only some 100–400 $\mu$m. A coarse granular material may well be milled into a powder, but normally with a-resulting temperature rise, which in the present connection would be liable to result in a "baking together" of the powder, rendering the powder useless in practice.

According to the invention, however, for an industrial production of the powder has been found possible to solve this problem, not in prescribing some new milling technique, but rather in prescribing that the raw material, prior to the milling thereof, is subjected to such an efficient cooling preferably even to a cryogenic cooling to below 100° C., that the processing heat added by the following milling operation will not bring up the temperature of the processed material to the sticking point thereof.

This is a very important aspect of the present invention, inasfar as it seems to be a key to the practical application of the wax to all sorts of surfaces, be it as paint or as an invisible protective impregnation of surfaces in general, e.g., various wooden or metal or concrete surfaces, including surfaces of ancient stone structures of historic importance.

It is expected that relevant wax coatings may be used and even especially developed or modified for a long series of specialized applications. As an important example, among many others, reference can be made to an exterior treatment of ship and boat hulls, where the hard wax is perfectly applicable, not only as a protective coating, but also as an environmentally totally neutral coating having pronounced anti-fouling properties which, of course, may be further enhanced by addition of special anti-growth agents in the wax itself. The coating, being cheap and both wear and climate resistant, is even likely to lower the degree of friction between the hull and the water.

In sailing boat marinas, it could be practical to arrange for a service station in which the boats could be passed through for a cleaning and waxing treatment almost as in car washing machines, though here with the wax in a heated condition.

The low friction property of the wax material may be relevant, even with respect to air friction on airplanes and windmill wings. In this connection, another relevant property is that an ice formation on a wax coating will not stick very firmly to the coated surface, such that, when icing occurs, the ice is likely to be loosened by air pressure or centrifugal forces. Still, the hard wax will be fully usable for such purposes because it is fully climate resistant even during warm periods.

The indicated low-friction characteristic of the wax may be advantageous also in other respects, e.g., in connection with slip properties of various types of shaping molds.

The "hard wax" does not contain water or solvents for later disappearance in a molded structure, and the hot and melted wax very effectively sticks to any surface to which it is supplied. It has been realized that these facts will account for another important application of the material, viz., as a joining or pointing material between inter-spaced solid items, such as paving stones or tiles. In this connection, the wax, with or without a filler material, may be used as a joining material, e.g., based on a granular material being swept into the interspaces between the laid out items and then activated by heating by means of an air heater or a blowtorch. Inasfar as no shrinking will occur, the stones or tiles will thereafter be intimately connected by way of a hard and non-corroding material, which is resistant also to mechanical sweeping and to the impact of high pressure cleaning water jets. A wax coated sand material will be perfect for this application.

For the same reason, the non-shrinking wax material will be highly applicable for the filling out of mold cavities, e.g. in connection with a molding out of holes in a concrete floor or stair steps for a firm anchoring of the bottom end of railing poles therein. Any visible surface of the wax material, with or without a filler material, may be smoothened out by means of a heated smoothening blade on a relevant hand tool.

The material will be perfectly suited as a repair mass in general, e.g., for floors in wet rooms.

Instead of sand, also other granular materials may be used as a carrier for the wax, and it is worth mentioning that rice grains have proved to be particularly advantageous. Basically, the wax material is a poor heat conductor, whereby it is well applicable in various skin touching products, such as toilet seats. On the other hand, it can be made heat conductive if it is mixed, e.g., with 10–30% of aluminum powder or another heat conducting material.

Correspondingly, the wax material is basically electrically insulating, but it can be made conducting with a sufficient addition of conductive material. This implies that it is possible to build up electronic substructures that are totally harmless when they are later on destroyed, this otherwise being a marked problem.

The wax material, whether alone or with an included filler material, has been found to have a noise damping effect on whichever surface it is applied. Thus, in many instances, it can be relevant to apply the material to plate structures of machines etc., and there is reason to believe that the material can be further modified for this purpose, e.g., by selection of suitable filler components.

The wax is well usable as a thin protective coating on different types of surfaces. In the building sector, it can serve as a mechanical protection on finished surface areas, for protection against damage during the remaining finishing work in the building. In the metal industry and particularly in regions with high air humidity, the wax is usable for corrosion protection even of raw materials and intermediate products; many working operations may be done despite the presence of a thin surface film.

The wax or "wax concrete" is well suited in connection with details pertaining to roads liable to be salted during winter, as it is resistant to salt water. Moreover, a mixture of wax coated sand and salt particles seems to have good anti-icing properties when used as a stabilized surface layer, e.g., on stair steps, such as on fire escape stairs.

In connection with sand or other granular material used as filler material or in coated condition, some 20–30% (by volume) of wax will often be suitable.

The wax, despite its character of a highly rigid and climate resistant material, will still be a combustible material, usable e.g., in kindling briquettes and torches, and as a binder in straw briquettes and the like. In particular, owing to its food grade status, it is perfectly usable as a packaging material, either by itself, e.g., as carrier plates or trays for foodstuff articles or as a coating on other packaging materials, and in both cases it will end up in the refuse system, in which it is directly useful because, in the associated refuse disposal plants, it will represent a high thermal value when actively burnt, already because it cannot possibly be soaked by water. The same will hold true for other carrier plates or trays, e.g., of cardboard, when these have been sprayed with or dipped into the wax, as even the edges there of will then also be wax coated, and thus, impervious to intrusion of water. This will apply, e.g., to carrier boards for sliced salmon and the like.

It should be mentioned as an extreme possibility that the wax can be usable for a resistant film coverage of bulk waste in order to enable the latter to be disposed of at unprotected dumping grounds. Also, in firework articles, the wax may be used to form a carrier substrate that is broken down in a well-controlled manner during the process of development of the pyrotechnical effects of the firework article.

What is claimed is:

1. A method of applying a wax coating onto an article surface, comprising the steps of:

providing a wax material in granular form;

applying the wax material to the article while still in a granular form and causing the wax material to adhere to the article; and heating the wax material adhered to the article to convert the wax material from a granular form into a continuous coating on the article, wherein the article to which the wax material is applied is one of a boat hull, a windmill wing, and an aircraft.

2. A method of applying a wax coating according to claim 1, wherein the wax material used has adhesive properties and wherein the article is pre-heated prior to the wax material being applied to the article.

3. A method of applying a wax coating according to claim 2, wherein the article is pre-heated to 40° C. or more.

4. A method of applying a wax coating according to claim 1, wherein the wax material is applied in a non-sticky form and is caused to become adherent by contact with the pre-heated article.

5. A method of applying a wax coating according to claim 1, wherein said applying is performed by the use of electrostatic attraction.

6. A method of applying a wax coating according to claim 1, wherein the wax material is caused to become adherent by passing the wax material through a heating zone preliminary to spraying the wax material onto the article.

7. A method of applying a wax coating according to claim 1, wherein the wax material is applied to the article without prior heating thereof.

8. A method of applying a wax coating according to claim 1, wherein the wax material in granular form is a powder having a grain size of 50–500 $\mu$m.

9. A method of applying a wax coating according to claim 1, wherein the wax material contains at least one of a pigment, anti-fouling agent, and an anti-icing agent.

10. A method of applying a wax coating according to claim 8, comprising the preliminary steps of preparing said powder by cryogenically cooling the wax material and comminuting the cooled wax material in a comminution mill.

11. A method of utilizing a wax coated granular material as a pointing compound, comprising the steps of:

filling the wax coated granular material loosely into gaps between objects to be seal together; and then heating the wax material to convert the loose wax coated granular material into a continuous pointing within the gaps.

12. A method of applying a wax coating onto an article surface, comprising the steps of:

providing a wax material in granular form;

applying the wax material to the article while still in a granular form and causing the wax material to adhere to the article; and heating the wax material adhered to the article to convert the wax material from a granular form into a continuous coating on the article, wherein the article is a stationary structure from the group consisting of buildings, bridges, and monuments.

* * * * *